US005232258A

United States Patent [19]

Rossi

[11] Patent Number: 5,232,258

[45] Date of Patent: Aug. 3, 1993

[54] HANDLE ASSEMBLY FOR ARTICLE CARRIER

[76] Inventor: Judy R. Rossi, P.O. Box 2056, Dale City, Va. 22193

[21] Appl. No.: 837,239

[22] Filed: Feb. 14, 1992

[51] Int. Cl.[5] ..... A45F 5/00

[52] U.S. Cl. ..... 294/152; 294/151

[58] Field of Search ..... 294/141, 142, 149, 151, 294/152, 153, 156, 157, 165, 9, 27.1, 32, 74; 16/116 R, 116 A

[56] References Cited

U.S. PATENT DOCUMENTS

| | | | |
|---|---|---|---|
| 423,380 | 3/1890 | Fry | 294/152 |
| 1,971,322 | 8/1934 | Miller . | |
| 2,306,062 | 12/1942 | Katz | 16/116 A X |
| 2,723,067 | 11/1955 | Fretz | 294/152 |
| 3,024,824 | 3/1962 | Bass | 294/149 X |
| 3,301,452 | 1/1967 | Jester . | |
| 3,779,156 | 12/1973 | Race | 294/152 X |
| 3,986,661 | 10/1976 | Johnson . | |
| 4,039,218 | 8/1977 | Bryant | 294/74 |
| 4,249,663 | 2/1981 | Hewlett . | |
| 4,881,684 | 11/1989 | Chinman | 294/152 X |

FOREIGN PATENT DOCUMENTS

| | | | |
|---|---|---|---|
| 556418 | 10/1943 | United Kingdom | 294/152 |

*Primary Examiner*—David M. Mitchell
*Assistant Examiner*—Dean J. Kramer
*Attorney, Agent, or Firm*—Neil F. Markva

[57] ABSTRACT

A handle assembly is provided for an article carrier having at least one flexible end section for manually grasping to cause the article being carried to suspend downwardly from the grasped end section. The distal end section includes a bifurcated distal portion having two laterally spaced flaps joined along a generally U-shaped inner peripheral edge profile. The flaps include closed outer peripheral edges that intersect closed distal end edges. Each of the spaced flaps include an elongated distal end loop structure having a longitudinal axis extending transversely to the inner peripheral edge profile. Each elongated distal end loop structure includes a closed secured edge extending parallel to the longitudinal axis and having facing loop openings with a diameter that receives opposing ends of a rigid rod member. The rod member has a length sufficient to extend substantially along the entire longitudinal axis of the distal end loop structure of both flaps. The length along the entire inner peripheral edge profile is sufficiently shorter than the length of the rod member to preclude the accidental disassembly of the rod member while the article carrier is in use.

17 Claims, 3 Drawing Sheets

Fig. 1
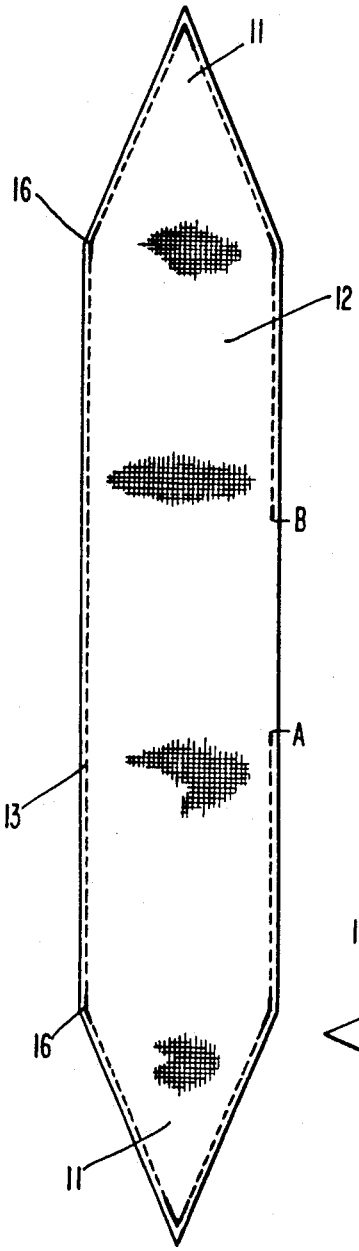
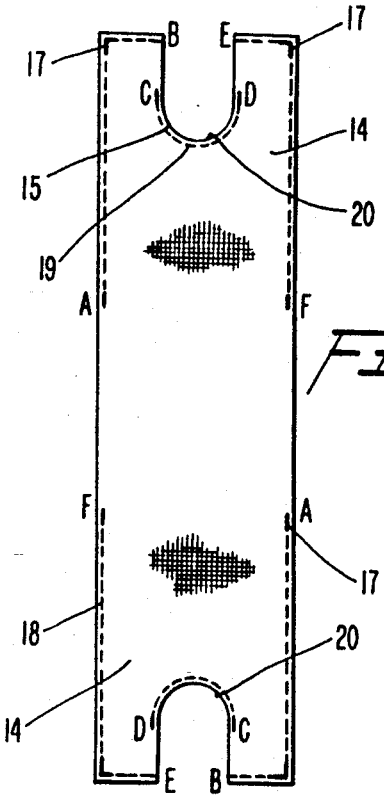
Fig. 2
Fig. 3
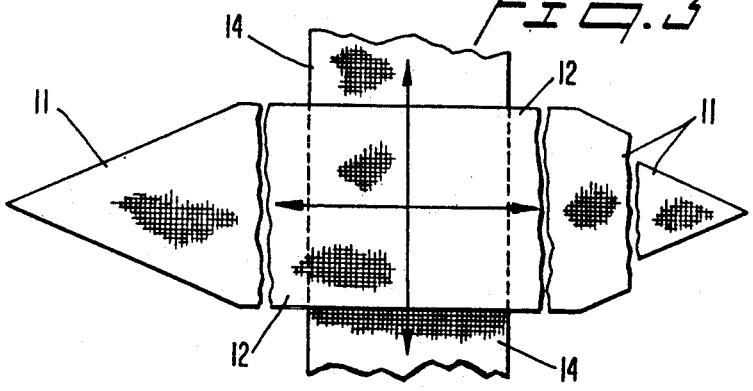
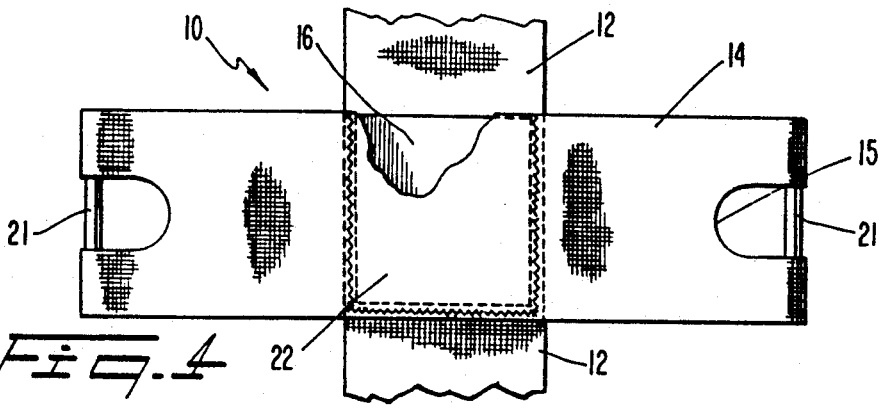
Fig. 4

HANDLE ASSEMBLY FOR ARTICLE CARRIER

FIELD OF THE INVENTION

This invention relates to article carrier handles. More particularly, the invention is directed to a handle assembly for an article carrier composed of a flexible fabric wherein a rigid rod member is used with a loop configuration of the fabric to form a handle assembly.

BACKGROUND OF THE INVENTION

The use of a rigid rod member such as a wooden dowel handle in combination with a loop structure in a fabric material is known. Pocket sections or loops are laterally spaced with respect to each other and fit over the ends of the elongated dowel. A solid piece of flexible fabric forms a U-shaped opening between the dowel and loop or pocket sections.

However, with the known configurations, the accidental disassembly of the rigid rod member from the fabric portion of the handle structure is common. Consequently, the article carrier is subject to mishandling and the potential for dropping and damaging the carried article is significant. Such a mishap while carrying a food container is particularly distasteful.

U.S. Pat. No. 3,301,452 discloses the general type of handle to which the present invention relates. This known handle assembly comprises stiffened adhesive-backed sheets forming a heavy Kraft paper laminated or adhesively secured together with an intermediate layer of reinforcing fibers. The rigid rod member is fixedly secured within the stiffened or rigid paper loops or rod end holding sections. Thus, the particular problem associated with flexible material such as cloth loops used with rigid rod members does not exist in this prior art handle assembly.

U.S. Pat. No. 3,986,661 discloses a plastic bag formed of flexible sheet material with a handle assembly including two end pockets used with two separate rigid members or dowel sections. Thus, the particular problem addressed in this invention is not present in this prior art structure.

U.S. Pat. No. 4,249,663 discloses a handle assembly having an end pocket configuration for holding the ends of a rod section. The loops are relatively stiff and slidingly engage a pair of horizontally oriented support arms. Thus, the problem specifically relating to the use of a single rod member in a distal end loop structure is not addressed in this patent.

U.S. Pat. No. 1,971,322 shows a flexible article carrying device with a flexible handle member fixedly attached at each end thereof to the distal ends of an article carrier.

While these earlier U.S. patents disclose the general state of the art, none are particularly directed to solving the problem recognized and solved by this invention.

PURPOSE OF THE INVENTION

The primary object of this invention is to solve the problem of having a rigid rod member accidentally disengaging from the flexible loop structure at the distal end of a handle assembly for an article carrier.

Another object of the invention is to provide a carrier assembly kit designed for easy assembly by the purchaser and incorporating the unique handle assembly of the invention.

SUMMARY OF THE INVENTION

This invention is first directed to a handle assembly for an article carrier having at least one flexible end section for manually grasping to cause the article being carried to suspend downwardly from the grasped end section.

The end section includes a bifurcated distal portion having two laterally spaced flaps joined along a generally U-shape inner peripheral edge profile. The flaps also include a closed outer peripheral edge that intersects closed distal end edges.

Each of the spaced flaps includes an elongated distal end loop structure having a longitudinal axis extending transversely to the inner peripheral edge profile. Each elongated distal end loop structure includes a closed secured edge extending parallel to the longitudinal axis. Each loop structure also includes a portion of the outer peripheral edge and facing loop openings having a diameter that receives opposing ends of a rigid rod member.

The rod member has a defined length that is greater than the distance measured along the inner peripheral edge profile between the center of each of the facing loop openings at the inner end of loop structures for each flap. The distance between the facing loop openings has a length effective to allow a rod member to be manually grasped when the rod member is inserted into the loop structure of each respective flap.

Moreover, the rod member length is sufficient to extend substantially along the entire longitudinal axis of the distal end loop structure of both flaps. The length along the entire inner peripheral edge profile is sufficiently shorter than the length of the rod member to preclude the accidental disassembly of the rod member while the article carrier is in use.

In a specific embodiment, the rod member is about nine (9) inches long, the spaced distance between the loop openings along the inner peripheral edges is about three (3) inches and the length of the peripheral edge profile between the center of each of the facing loop openings is about seven and one-half (7½) inches. The length of the inner peripheral edge profile measured between the distal end edge of each loop structure is about eight (8) inches. The rod member has a diameter of about one-half (½) of an inch.

Another feature of the invention is directed to the configuration of each flap having a width of about three and one-half (3½) inches. The flexible end section of the handle assembly is composed of two opposing sheets of cloth material stitched along the peripheral edges thereof.

In a specific embodiment of the novel article carrier, the handle assembly has two flexible end sections each having a bifurcated outer portion with a rod member disposed in elongated loop structures located at the distal end of each flap. The article carrier has a carrier tying element fixedly secured to a carrier handle element with the tying and handle elements disposed perpendicularly with respect to each other. The carrier tying element intersects the carrier handle element at an intermediate base portion including rigid base member inserted into a flexible base member pocket.

The carrier tying element and carrier handle element are each composed of cloth materials stitched to secure the elements together forming the flexible base member pocket. The carrier handle element comprises two identically shaped cloth pieces stitched together along the outer peripheral edges thereof leaving facing loop openings having an inner diameter effective to slip-fit over the outer diameter of the inserted rod member. The carrier tying element has convergent end portions to enhance the tying of the rod members together through the U-shaped inner peripheral edge profile.

Another feature of the invention is directed to a carrier kit assembly for producing an article carrier having the unique handle assembly of the invention. The kit comprises two identically shaped tying element pieces, two identically shaped handle element pieces and two identically shaped rod members and a rigid base member.

The two tying element pieces and the two handle element pieces include a primary print design located on one side of a first tying element piece and on one side of a first handle element piece. A secondary print design is located on one side of the second tying element piece and on one side of the second handle element piece. Securing the tying element pieces together along the outer edges thereof forms a carrier tying element and likewise securing the handle element pieces together forms a carrier handle element.

The carrier tying and handle elements are perpendicularly disposed with respect to each other. One of the elements is located between the two pieces forming the other of said carrier elements to provide an intersecting base support portion having an outer edge profile.

The carrier tying and handle elements are securable along the outer edge profile of the base support portion to form a pocket on each side of the one carrier element disposed between the two pieces of the other carrier element. A rigid base member is disposed in one of the pockets to provide support and absorb heat. This is particularly useful for carrying hot food containers. The base member may be placed in either pocket thereby making the carrier assembly reversible.

Each of the rod members has a definitive length and diameter. Each of the handle element pieces includes two bifurcated distal end portions having two laterally spaced flat sections forming a substantially U-shaped inner peripheral edge portion therebetween. When secured along the edge portions of the paired handle pieces, facing openings are formed along the inner peripheral edge to receive the outer ends of the rod.

The length of the inner peripheral edge profile is sufficiently less than the definitive length of the rod members to preclude the accidental disassembly of the rod members from the flap structures when the carrier kit is assembled. Thus, when the flexible fabric of the flaps is pulled outwardly toward the respective ends of the elongated rod member, the overall distance of the flaps that are pulled outwardly from each other is less than the overall length of the rod member. Consequently, this structural configuration obviates the problems associated with such known structures.

In a particular feature of the kit assembly, the rigid base member is a rectangular sheet of solid material and more specifically a substantially square piece of Masonite. The carrier tying and handle element pieces are composed of cloth material. In a specific embodiment, the size and shape of the base support portion is effective to support a food container.

BRIEF DESCRIPTION OF DRAWINGS

Other objects of this invention will appear in the following description and appended claims, reference being made to the accompanying drawings forming a part of the specification wherein like reference characters designate corresponding parts in the several views.

FIG. 1 is a plan view of a carrier tying element made in accordance with the invention;

FIG. 2 is a plan view of a carrier handle element made in accordance with the invention;

FIG. 3 is a plan view showing the method of assembling the carrier tying element to the carrier handle element in accordance with the invention;

FIG. 4 is a plan view showing the configuration of a base support portion upon fixedly securing the carrier tying element to the carrier handle element in accordance with the invention;

DETAILED DESCRIPTION OF INVENTION

Figure 9:
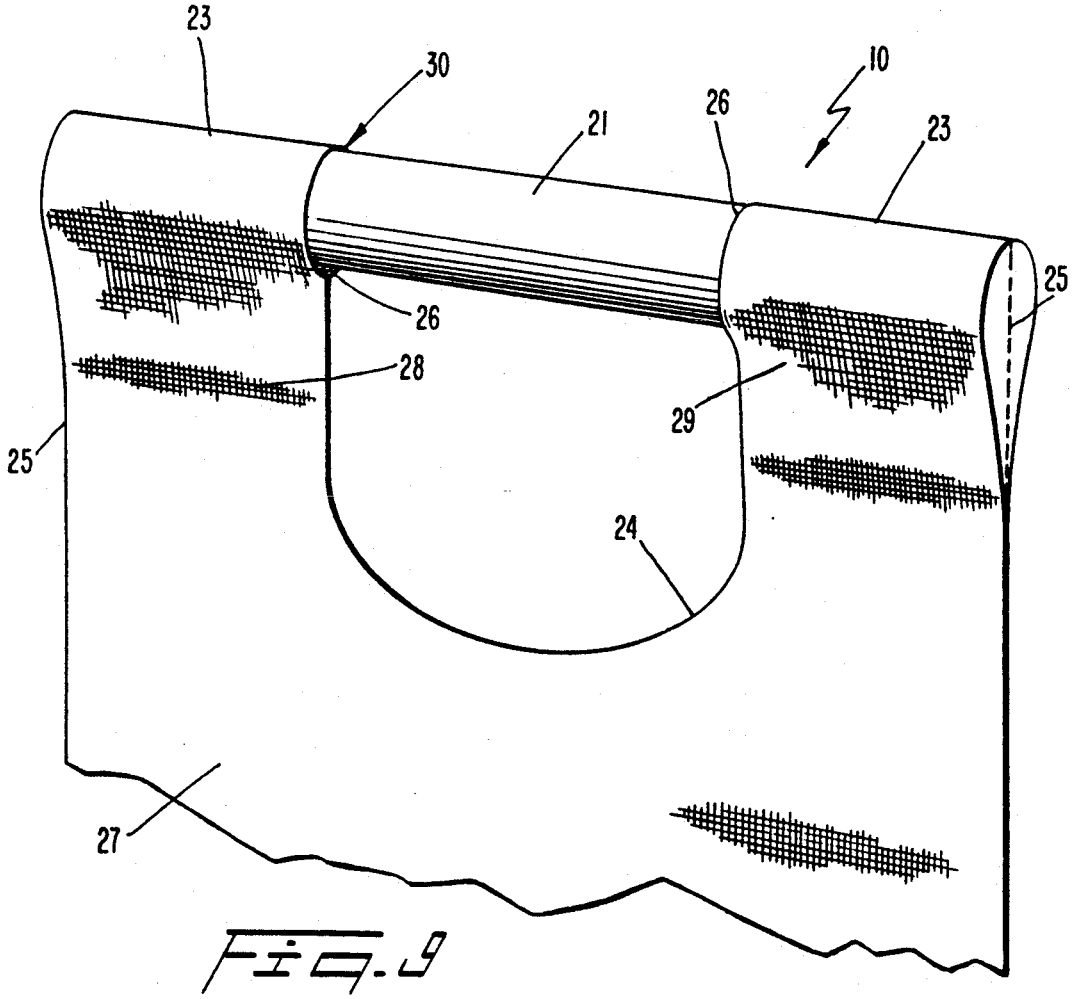
FIG. 9 is a fragmentary perspective view of a handle assembly made in accordance with the invention.

A food carrier, generally designated 10, includes a unique handle assembly as shown in FIG. 9. At least one flexible end section 27 is shown for an article carrier in which the rod member 21 may be manually grasped to cause the article being carried to suspend downwardly from grasped end section 27.

The end section 27 includes a bifurcated distal end portion with two laterally spaced flaps 28 and 29 joined along a generally U-shaped inner peripheral edge profile 24. Closed outer peripheral edges 25 intersect closed distal end edges 23 on each of the flaps 28 and 29.

Each of the flaps 28 and 29 includes an elongated distal end loop structure 30 having longitudinal axis extending transversely to the inner peripheral edge profile 24. Each elongated distal end loop structure 30 includes a closed secured edge extending parallel to the longitudinal axis and facing loop openings 26 have a diameter that receives opposing ends of rigid rod member 21.

Rod member 21 has a defined length that is greater than the distance measured along the inner peripheral edge profile 24 between the center of each of the facing loop openings of the respective distal end loop structures of each flap 28 and 29.

The distance between the facing loop openings 26 have a length effective to allow rod member 21 to be manually grasped when rod member 21 is inserted into loop structures 30. As shown, rod member 21 has a length sufficient to extend substantially along the entire longitudinal axis of the distal end loop structure 30 of flaps 28 and 29. The length along the entire inner peripheral edge profile 24 is sufficiently shorter than the length of rod member 21 to preclude the accidental disassembly of rod member 21 while article carrier 10 is in use.

In this specific embodiment, rod member 21 is about nine (9) inches long, the spaced distance between facing openings 26 along inner peripheral edge 24 is about three (3) inches. The length of the peripheral edge profile 24 between the center of each of the facing loop openings is about seven and one half (7½) inches. The width of each flap 28 and 29 is about three and one half (3½) inches as measured along distal end edge 23.

Flexible end section 27 is composed of two opposing sheets of cloth stitched along the peripheral edges thereof in this particular embodiment. In the specific embodiment of this invention, carrier handle element 14 has two flexible end sections each having a bifurcated outer portion with a rod member 21 extending into elongated distal end loop structures 30. FIGS. 5–8 show a particular article carrier having a carrier tying element 12 fixedly secured to a carrier handle element 14 with tying element 12 being perpendicularly disposed with respect to carrier handle element 14.

Article carrier 10 in this specific embodiment is designed as a food container carrier. A feature of the invention is to provide a carrier kit assembly which includes two identically shaped tying element pieces stitched along the outside thereof to form a cloth tying element 12 (FIG. 1). In this embodiment, a primary print design is located on one side of a first tying element piece and a secondary print design is located on one side of the second tying element piece. The sides of the pieces bearing the primary and secondary print design are contiguously disposed.

Once the print design sides are together, sewing begins at point A around the entire piece to point B as shown. This leaves a four (4) inch center opening between points A and B so that tying element 12 may be turned inside out through that opening. Backstitching 16 at various corners and other stress areas reinforce the cloth material at those points. Excess fabric is trimmed at the points and the part is then turned inside out and pressed with an iron to flatten the tying element.

The carrier handle element 14 is also composed of two identically shaped pieces of cloth material. Again, a primary print design is located on one side of a first handle element piece and a secondary print design is located on one side of the second handle element piece. The sewing procedure is identical for each end of the carrier handle member. First sewing takes place along one edge from point A to point B with reinforcing backstitching taking place at the stress area 17. Next, sewing takes place from point C to point D and finally from point E to point F. This procedure is repeated at opposite ends of the carrier handle piece as shown.

Upon sewing the two pieces together as shown in FIG. 2, V-shaped clips 20 are cut at five different locations along the U-shaped curve. Once the two pieces are sewn together as described, the carrier handle element is then turned inside out through one of the openings formed between points A and F along one edge of the sewn element 14.

Assembly of the carrier elements 12 and 14 is shown in FIG. 3. With secondary print sides up, pointed convergent portion 11 of tying element 12 is inserted through the opening formed between points A and F on either side of the carrier handle element 14. Once all sides are centered and the outer points of converging portions 11 are equidistant from the center of the carrier handle element 14, both sides of handle element 14 are securely pinned together.

As shown in FIG. 4, satin stitching or a fine zigzag stitch is started on the pocket edge and about one quarter (¼) inch to the left of the tying element as shown. Backstitching is started from along the pocket edge and proceeds forward for one half (½) inch with the balance of the stitching being widened to a regular length and sewn to within one half (½) inch of the corner. Two ninty degree turns are effected with satin stitching pivotably effected around the corners to thereby form a base member pocket 22.

Finally, the assembled and secured carrier assembly is ironed and rod member 21 is placed into facing openings 26 at each end of carrier handle element 14 in the fashion shown and described in FIG. 9.

A rigid square base member 16 is then placed in the pocket of the base member support portion. In a specific embodiment, a one eighth (⅛) inch thick square piece of tempered Masonite is used. The specific embodiment of the width of the carrier tying element and carrier handle element is about ten (10) inches in this specific embodiment. A base member 16 having an eight (8) inch square piece of tempered Masonite is used in the base member pocket.

Figure 5:
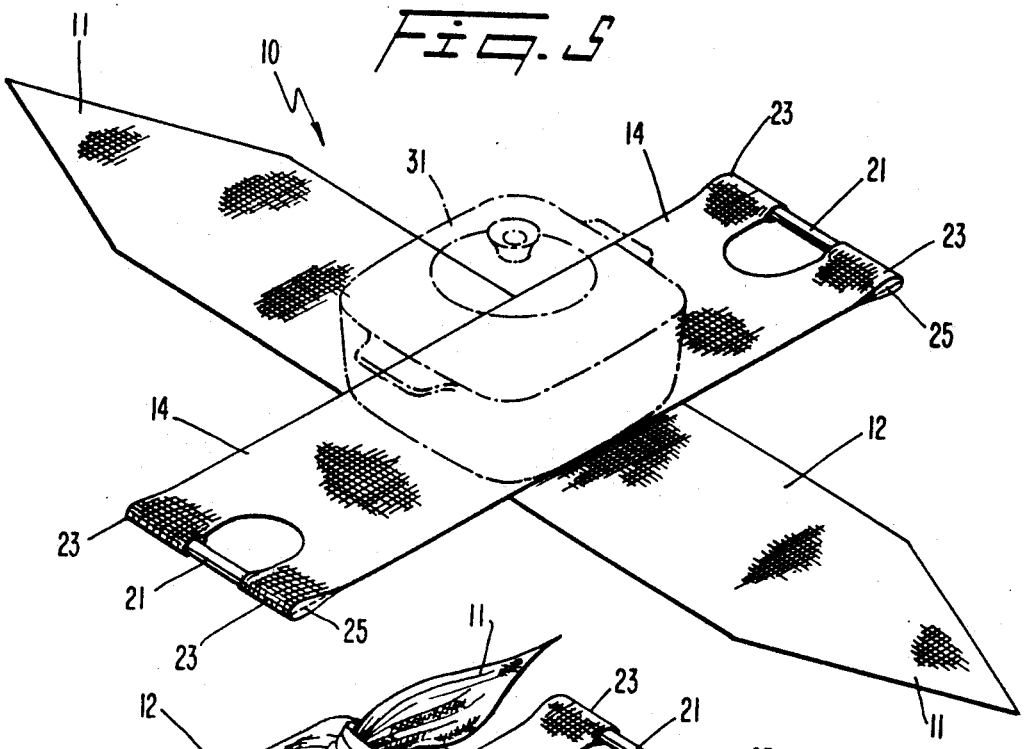
FIGS. 5–8 are each perspective views showing the specific use of the article carrier for carrying food containers in accordance with the invention.
Figure 6:
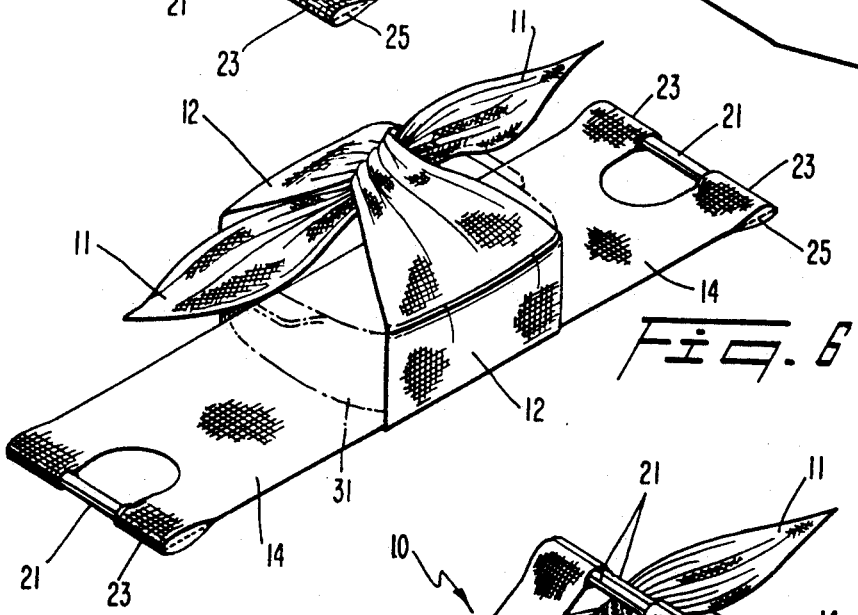
Figure 7:
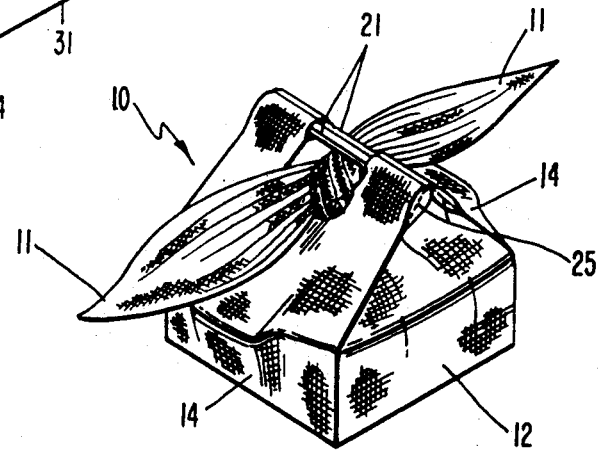
Figure 8:
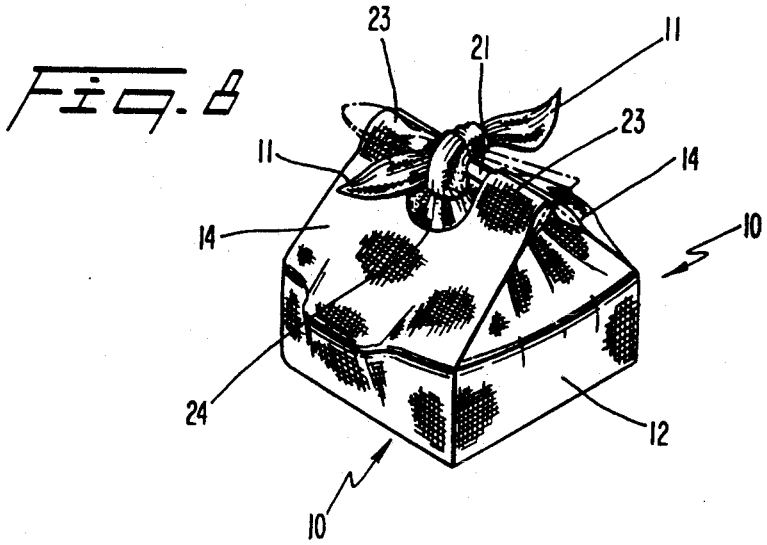

FIGS. 5–8 show the use the food carrier assembly 10 of this invention. Food carrier 31 is first placed on the support base as shown in FIG. 5. The ends of carrier tying element 12 are tied together after being placed over the top of container 31 as shown in FIG. 6. Handle assembly ends are then brought together with convergent portions 11 of tying element 12 extending through the U-shaped opening formed when rod member 21 is in place as shown in FIG. 7. The outer convergent ends of tying element 12 are then tied again over the juxtaposed dowel members With the primary and secondary print designs located as described above, the food carrier assembly 10 may be reversed by removing the rigid base member from one pocket and inserting it to the other pocket and simply turning carrier assembly 10 over. Two pockets are formed on either side of carrier tying element 12 when placed through the two handle element pieces as shown in FIG. 3.

While the handle assembly for article carrier has been shown and described in detail, it is obvious that this invention is not to be considered as limited to the exact form disclosed, and that changes in detail and construction may be made therein within the scope of the invention without departing from the spirit thereof.

I claim:

1. A handle assembly for an article carrier, said assembly comprising:

a) an article carrier having at least one flexible end section for manually grasping to cause the article being carried to suspend downwardly from the grasped end section, b) said end section including a bifurcated distal end portion having two laterally spaced flexible flaps joined along a generally U-shaped inner peripheral edge profile and being secured along the inner peripheral edge profile that is secured to a point short of the distal end edges to form loop openings in said peripheral edge profile that intersect closed distal end edges secured only along said distal end edges, c) each of the distal end edges extending outwardly from the loop opening located at the outer end of the inner peripheral edge profile, and transversely to the inner peripheral edge profile, d) each of the elongated distal end edges including said loop opening thereby providing two facing loop openings having a diameter that receives opposing ends of a rigid rod member, e) the rod member having a defined length that is greater than the distance measured along the inner peripheral edge profile between the center of each of the facing loop openings of each flap, f) the distance between the facing loop openings having a length effective to allow a rod member to be manually grasped when the rod member is inserted into the loop opening of each respective flap, g) the length along the entire inner peripheral edge profile is sufficiently shorter than the length of the rod member to preclude the accidental disassembly of the rod member while the article carrier is in use.

2. An assembly as defined in claim 1 wherein the rod member has a length sufficient to extend substantially along the entire distal end edges of both flaps.

3. An assembly as defined in claim 2 wherein the rod member is about 9 inches long, the spaced distance between the facing openings along the inner peripheral edges is about 3 inches and the length of the inner peripheral edge profile measured between the center of each of the facing loop openings is about 7½inches.

4. An assembly as defined in claim 1 wherein the width of each flap is about 3½inches as measured along the distal end edge.

5. An assembly as defined in claim 1 wherein the flexible end section is composed of two opposing sheets of cloth material stitched along the outer distal end edges and the inner edge of the inner peripheral edge profile to form the loop openings.

6. An assembly as defined in claim 1 wherein the article carrier has two flexible end sections each having a bifurcated outer portion with a rod member extending through the facing loop openings and along the inside of the elongated distal end edges located at the distal end of each flap.

7. An assembly as defined in claim 6 wherein the article carrier includes a carrier tying element fixedly secured to a carrier handle element at an intermediate portion of each element with the tying and handle elements disposed perpendicularly with respect to each other.

8. A handle assembly for an article carrier, said assembly comprising:

a) an article carrier having two flexible end sections for manually grasping to cause the article being carried to suspend downwardly from the grasped end section, b) each said end section including a bifurcated distal end portion having two laterally spaced flaps joined along a generally U-shaped inner peripheral edge profile and with closed outer peripheral edges that intersect closed distal end edges, c) each of the spaced flaps including an elongated distal end loop structure having a longitudinal axis extending transversely to the inner peripheral edge profile, d) each elongated distal end loop structure including a closed secured edge extending parallel to said longitudinal axis and facing loop openings having a diameter that receives opposing ends of a rigid rod member, e) the rod member having a defined length that is greater than the distance measured along the inner peripheral edge profile between the center of each of the facing loop openings of the respective distal end loop structures of each flap, f) the distance between the facing loop openings having a length effective to allow a rod member to be manually grasped when the rod member is inserted into the loop structure of each respective flap, g) the article carrier including a carrier tying element fixedly secured to a carrier handle element with the tying and handle elements disposed perpendicularly with respect to each other, h) the carrier tying element intersects the carrier handle element at an intermediate base portion which includes a rigid base member inserted into a flexible base member pocket.

9. An assembly as defined in claim 8 wherein the carrier tying element and carrier handle element are each composed of two cloth material element pieces stitched to secure the element pieces together to form the carrier tying element and carrier handle element, and to form the flexible base member pocket.

10. An assembly as defined in claim 9 wherein the carrier tying element has convergent end portions to enhance the tying of the rod members together through the U-shaped inner peripheral edge profile.

11. An assembly as defined in claim 9 wherein the carrier handle element comprises two identically shaped cloth pieces stitched together along the outer peripheral edges leaving the facing loop openings having an inner diameter effective to slip-fit over the outer diameter of the inserted rod member.

12. A carrier kit assembly for producing an article carrier, said kit comprising:

a) two identically shaped tying element pieces, two identically shaped handle element pieces, two identically shaped rod members and a rigid base member, b) the two tying element pieces and the two handle element pieces are composed of flexible material securable together along the outer edges thereof to form a tying carrier element and a handle carrier element, respectively, c) the tying and handle carrier elements being perpendicularly disposed with respect to each other with one of the carrier elements being located between the two pieces forming the other of said carrier elements to provide an intersecting base support portion having an outer edge profile, d) said carrier tying and handle elements being securable along the outer edge profile of the base support portion to form a pocket on each side of the one carrier element disposed between the two pieces of the other carrier element, e) each of the rod members having a definitive length and diameter, and f) each of the handle element pieces including two bifurcated distal end portions having two laterally spaced flap sections forming a substantially U-shaped inner peripheral edge profile therebetween, g) the length of said inner peripheral edge profile being sufficiently less than the definitive length of the rod members to preclude the accidental disassembly of the rod members from the flap structures when the carrier kit is assembled.

13. A kit assembly as defined in claim 12 wherein the rigid base member is a rectangular sheet of solid material.

14. A kit assembly as defined in claim 13 wherein the rectangular sheet is a substantially square piece of tempered Masonite.

15. A kit assembly as defined in claim 12 wherein the carrier tying and handle element pieces are composed of cloth material.

16. A kit assembly as defined in claim 12 wherein the base support portion has a size and shape effective to support a food container.

17. A kit assembly as defined in claim 12 wherein a primary print design is located on one side of a first tying element piece and on one side of a first handle element piece and a secondary print design is located on one side of the second tying element piece and on one side of the second handle element piece.

* * * * *